US005129838A

United States Patent [19]

Bendorf et al.

[11] Patent Number: 5,129,838

[45] Date of Patent: Jul. 14, 1992

[54] PIN SAVING BOARD STOP

[75] Inventors: Robert L. Bendorf; Douglas R. Sarver, both of Millerstown, Pa.

[73] Assignee: AMP Incorporated, Harrisburg, Pa.

[21] Appl. No.: 780,585

[22] Filed: Oct. 22, 1991

[51] Int. Cl.[5] ..... H01R 13/62

[52] U.S. Cl. ..... 439/372; 439/357; 439/65

[58] Field of Search ..... 439/326-328, 439/152-160, 372, 345, 329, 65

[56] References Cited

U.S. PATENT DOCUMENTS

| | | | |
|---|---|---|---|
| 4,447,102 | 5/1984 | Kourimsky et al. | 439/345 |
| 4,620,761 | 11/1986 | Smith et al. | 439/372 |
| 4,824,392 | 4/1989 | Billman et al. | 439/372 |
| 4,960,387 | 10/1990 | Davis et al. | 439/374 |
| 5,017,147 | 5/1991 | Sugiyama et al. | 439/372 |

*Primary Examiner*—David L. Pirlot
*Attorney, Agent, or Firm*—Katherine A. Nelson

[57] ABSTRACT

An electronic assembly including a pair of complementary connectors (28,40), each mounted to respective circuit boards (22,34) and means for preventing damage to pin contacts (32) of one connector (28) when the connectors (28,40) are unmated, the connectors (28,40) and their respective circuit boards (22,34) defining first and second subassemblies. The pin saving means includes at least one pair of stop means (50) associated with one subassembly and adapted to cooperate with stop engaging means for the other subassembly. The stop means (50) includes a lower portion (52) extending in a direction perpendicular to the plane of the associated subassembly and a lower portion (54) extending outwardly from a leading end thereof and having a stop surface (56). The upper portion (54) is adapted to be moved from a first position wherein the stop surface (56) engages the stop engaging means to a second position wherein the stop surface (56) is removed from the stop engaging means. In its first position, the upper portion stop surface (56) is located a selected distance from stop engaging means to permit the first and second connectors (28,40) to be partially unmated and the contact surfaces of the pin contacts (32) to be withdrawn from the receptacle contacts (46) while preventing the connectors (28,40) from rotating a sufficient amount to damage the pin contacts (32). The first and second connectors (28,40) are completely separable upon moving the upper stop means portion to their second positions.

5 Claims, 9 Drawing Sheets

Fig. 2
PRIOR ART
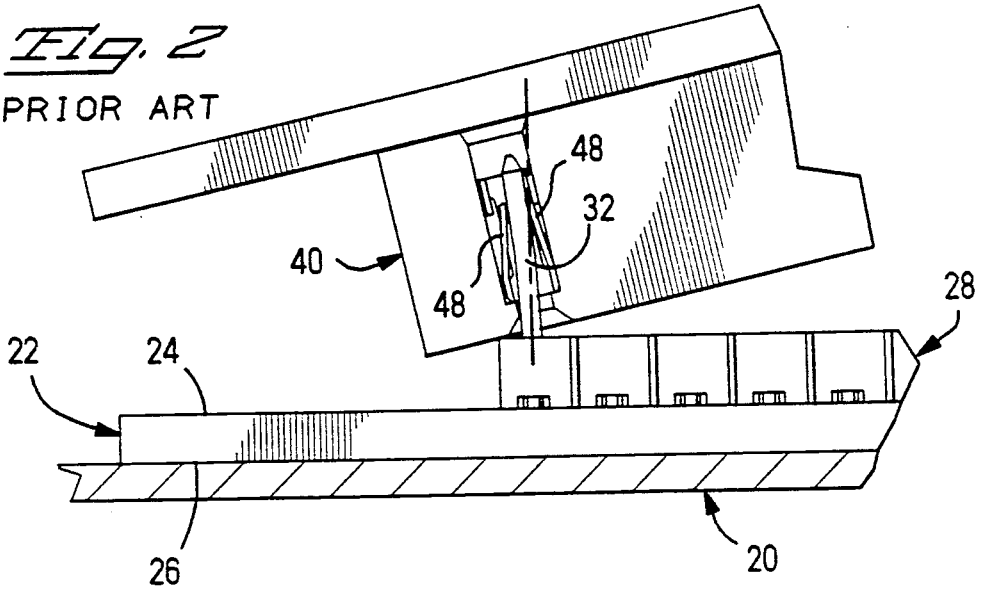
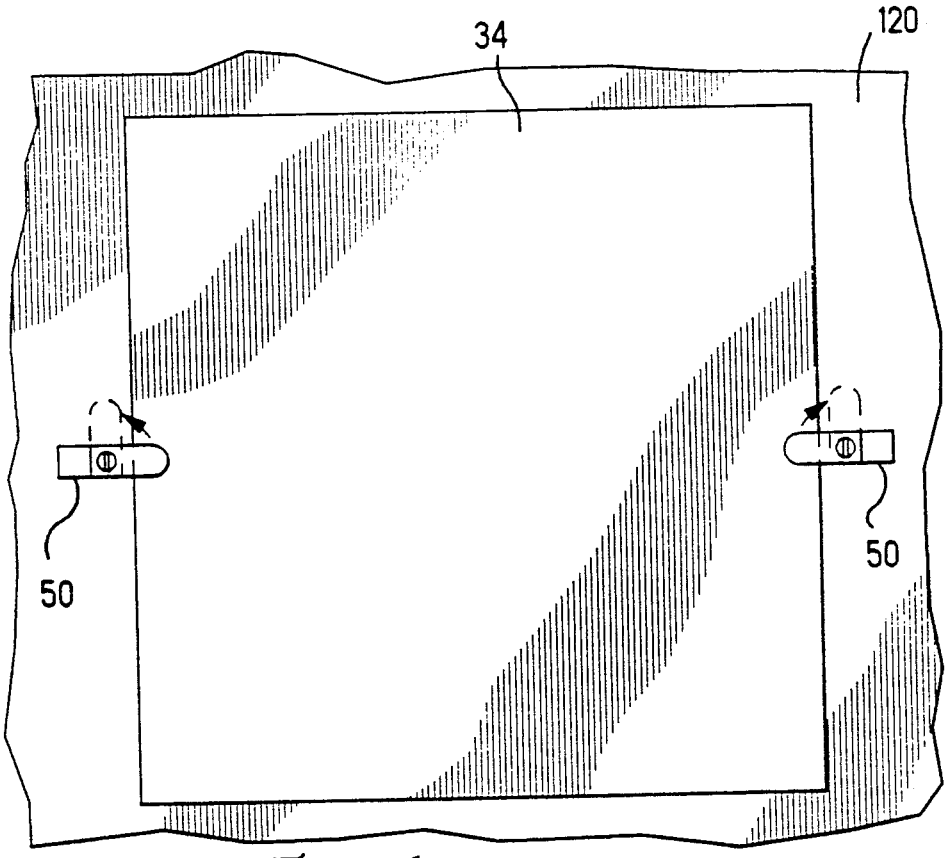
Fig. 4

PIN SAVING BOARD STOP

FIELD OF THE INVENTION

The present invention relates generally to electrical connectors and more particularly to connectors used to interconnect circuit boards and a means for preventing damage to the pin contacts of the connectors during unmating from a complementary connector.

BACKGROUND OF THE INVENTION

Electronic devices such as computers and the like typically use a plurality of circuit boards having a variety of electronic components mounted thereto. The boards are interconnected to each other by one or more electrical connectors that may be periodically mated or unmated from one another. In some applications an interconnection between parallel circuit boards may require the use of a plurality of mated complementary connectors. The magnitude of force required to separate such boards depends upon the number, design and size of the connector assemblies used to interconnect the boards. Often, the operation of separating the two boards may be performed in a rather careless fashion. It is not uncommon, for example, to disconnect the connectors on parallel boards in a manner that tends to rotate the respective boards and connectors thereby applying tension having a non-axial force component which in turn imparts a torque on the respective connector assemblies during board separation. The problems associated with separating the boards become more acute as the number of mating connectors between the boards is increased.

Typically a connector assembly includes a receptacle connector having one or more receptacle contacts and a plug connector having one or more pin contacts, which are designed to enter into the receptacle contacts when the two complimentary connectors are mated, and to be withdrawn from the receptacle contacts when the connectors are unmated. The plug connector is known as a "pin header" and has an array of pin contacts that may be "open", that is, completely free of dielectric housing or may be surrounded by a shroud or other housing portions. The connectors are adapted to be mated and unmated by relative movement of the connectors toward and away from each other in directions substantially parallel to the longitudinal axes of the receptacle and pin contacts. If, however, the connectors are mated or unmated such that one of the connectors is turned or rotated a sufficient distance relative to its complementary connector, the pin contacts may be pressed against the sidewalls of the receptacle contacts and be bent out of position, thus damaging the plug connector and rendering the connector assembly incapable of being properly mated thereafter. The pin contacts are particularly receptive to damage when subject to the force of disengaging a plurality of connectors by applying force to only one edge of the boards.

It is desirable therefore to protect the pin contacts while separating the circuit boards and unmating the complementary connectors mounted thereto.

It is further desirable that this protection be accomplished in a cost effective manner that will not increase the complexity of the housing structure.

U.S. Pat. No. 4,960,387 discloses a "pin saver" structure for preventing pin contacts from being bent when a pair of complementary connectors are mated or unmated in a careless fashion. The "pin saver" structure comprises a plurality of ledges or projections surrounding one of the connectors for defining outwardly extending fulcrums around which the other connector will be rotated or turned. The extended fulcrums on the one mating connector provide a surface for engaging housing portions of the other mating connector if the second connector is rotated during the unmating of the two connectors. The extended fulcrums, however, add to the length of the connector and therefore occupy more "real estate" on a circuit board than a connector without such protection. This problem is even more acute when there are a plurality of connectors on the mother board or back plane that are to be mated with connectors on daughter cards. It is desirable, therefore, to have a means for saving the pin that minimizes the amount of space required on the back plane or mother board.

SUMMARY OF THE INVENTION

The present invention relates to an electronic assembly that includes circuit boards each having complimentary connectors thereon defining first and second subassemblies that are intended to be periodically mated or unmated from one another and further includes structure for preventing damage to pin contacts of the connectors particularly when they are unmated in a careless fashion.

For purposes of illustrating the invention, the various electronic components, such as memory chips, resistors, capacitors, and electronic circuitry have been eliminated from the drawings. Further, the operation of the stop means of the invention will be shown in relation to only one connector. It is to be understood that a pair of stop means may be used to protect a plurality of connectors depending upon the design of the electronic assembly.

In accordance with the invention the electronic assembly includes a first circuit board having at least one first electrical connector mounted thereto, defining a first subassembly; a second circuit board having at least one second electrical connector mounted thereto, defining a second subassembly and at least one pair of pin saving means mounted proximate opposed side edges of at least one of the circuit boards. The second connector is adapted to mate with the first connector when the first and second circuit boards are placed in an overlying relationship and moved toward one another in a direction substantially parallel to the axes of the receptacle and pin contacts disposed within the connectors. The pin saving means includes at least one pair of stop means associated with one of the subassemblies and adapted to cooperate with stop engaging means of the other subassembly. Each stop means includes a first or lower portion and a second or upper portion. The lower portion extends in a direction perpendicular to the plane of the associated circuit board and has a leading end that extends a selected distance to the upper portion. The upper portion of the stop means includes a flange that extends outwardly in a transverse direction to the lower portion. The upper portion is adapted to be moved from a first position wherein a stop surface on said flange engages a stop engaging means of the other subassembly to a second position wherein the stop surface no longer engages the stop engaging means. In use, the at least one pair of stop means prevent the subassemblies and their respective connectors from being rotated a sufficient amount to cause damage to the pin contacts. Upon moving the upper stop portion to the second position, the first and second connectors are completely separable. The stop means of the present invention is suitable for use with connectors on boards that are either in a parallel or perpendicular relationship.

According to the presently preferred embodiment of the invention, the stop means is comprised of two members, the first or lower member being associated with one of the subassemblies and mounted either to the respective circuit board or proximate the edges thereof and the second or upper member being rotatably mounted to the leading end of the lower member. In its first position, upper member engages a stop engaging means of the second subassembly and is disengaged therefrom upon being rotated to a second position. When the connectors are mounted to boards that are parallel to each other after the connectors are mated, the stop engaging means is the under surface of the board of the other subassembly. When the connectors are mounted to boards that are perpendicular to each other, the stop engaging means may be the connector housing of the other subassembly or may be part of the circuit board such as, for example, a notch along the edge thereof. In an alternative embodiment the stop means is a one-piece member molded from a material having sufficient resiliency that the upper portion may be resiliently bent away from the boards to permit removal of the connector and attached board.

In accordance with the invention the upper portion of the stop means includes a stop surface that is spaced a selected distance above the associated board so that the mated connectors may be partially unmated and the contact surfaces of the pin contacts may be withdrawn from the receptacle contacts while concomitantly preventing the connectors from being rotated far enough to cause damage to any of the pin contacts that have not yet been disengaged from the corresponding receptacle contacts.

It is an object of the present invention to provide a means to prevent damage to pin contact members as to mating connectors and to do so in a cost effective manner.

It is a further object of the invention to provide a means for protecting the contacts of mating connectors while minimizing the amount of board space necessary to achieve the desired protection.

Embodiments of the present invention will now be described by way of example with reference to the accompanying drawings.

BRIEF DESCRIPTION OF THE DRAWING

FIG. 2 is an enlarged portion of the connector of FIG. 1.

FIG. 4 is a top plan view of a circuit board assembly having the pin saving structure of the present invention.

DETAILED DESCRIPTION OF THE DRAWINGS

Figure 1:
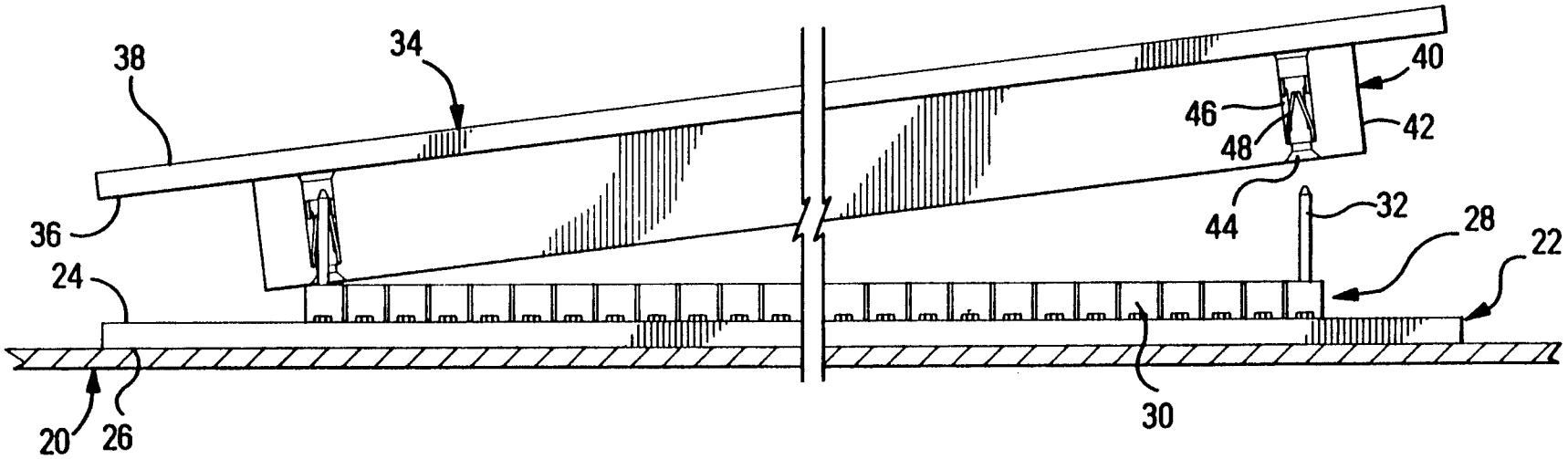
FIG. 1 PRIOR ART
FIG. 1 illustrates a pair of complementary connectors mounted to circuit boards, which do not incorporate the pin saving means of the present invention, as the connectors are being unmated, the housing of the connectors being partially broken away to help explain the invention.

FIGS. 1 and 2 illustrate a prior art electronic assembly that does not incorporate a pin saver device.

FIGS. 3, 4 and 6–8 illustrate an electronic assembly made with the pin saver device 50 in accordance with the invention. For purposes of illustrating the invention the electronic assemblies are shown with the same pair of complementary electrical connectors 28,40. For this reason the same numbers will be used for the connectors throughout the description. It is to be understood that these connectors are merely representative of connectors with which the invention may be used. FIGS. 1 and 2 are identified as prior art only to the extent that the electronic assembly does not include the pin saver structure in accordance with the present invention. It is not considered to be prior art for any other purpose.

FIGS. 1 and 2 illustrate a problem associated with electronic assemblies of the prior art. The electronic assembly includes a first circuit board 22 having a pin header connector 28 mounted to the upper surface 24 thereof and defining a first subassembly. Connector 28 includes a housing 30 having a plurality of pin contacts 32, only two of which are shown. For purposes of illustrating the invention, only the end pin contacts 32 are shown and those portions of the contacts, such as solder tails, compliant sections or the like, which extend below the circuit boards have been eliminated. The pin header assembly 28 used to illustrate the invention is known in the art as a break away header and includes a plurality of interconnected modules having corresponding pin contacts therein. As seen in FIGS. 1 and 2, the first subassembly or backplane is secured to a chassis 20 along lower board surface 26 by means (not shown) known in the art.

The mating connector 40 is mounted to a second circuit board 34 and together define a second subassembly. Connector 40 includes housing 42 having a plurality of passageways 44 extending therethrough and receptacle terminal members 46 disposed within respective passageways 44 and adapted for mating with corresponding pin contacts 32. As best seen in FIG. 2 the receptacle contact 46 includes parallel beams 48 having a contact section at the upper edge thereof. The second connector 40 is mounted to a first side 36 of circuit board 34.

FIGS. 1 and 2 illustrate the pair of complimentary connectors 28, 40 in the process of being unmated from one another and having one corresponding set of contacts 32, 46 disengage from each other while the pin 32 on the other end of connector 28 remains engaged in the corresponding receptacle 46. As is best seen in FIG. 2, pin 32 becomes bent, as the upper circuit board 34 is rotated. The bending degree is illustrated by referring to FIG. 2 and the broken line which shows the center of the pin 32 prior to bending.

Figure 3:
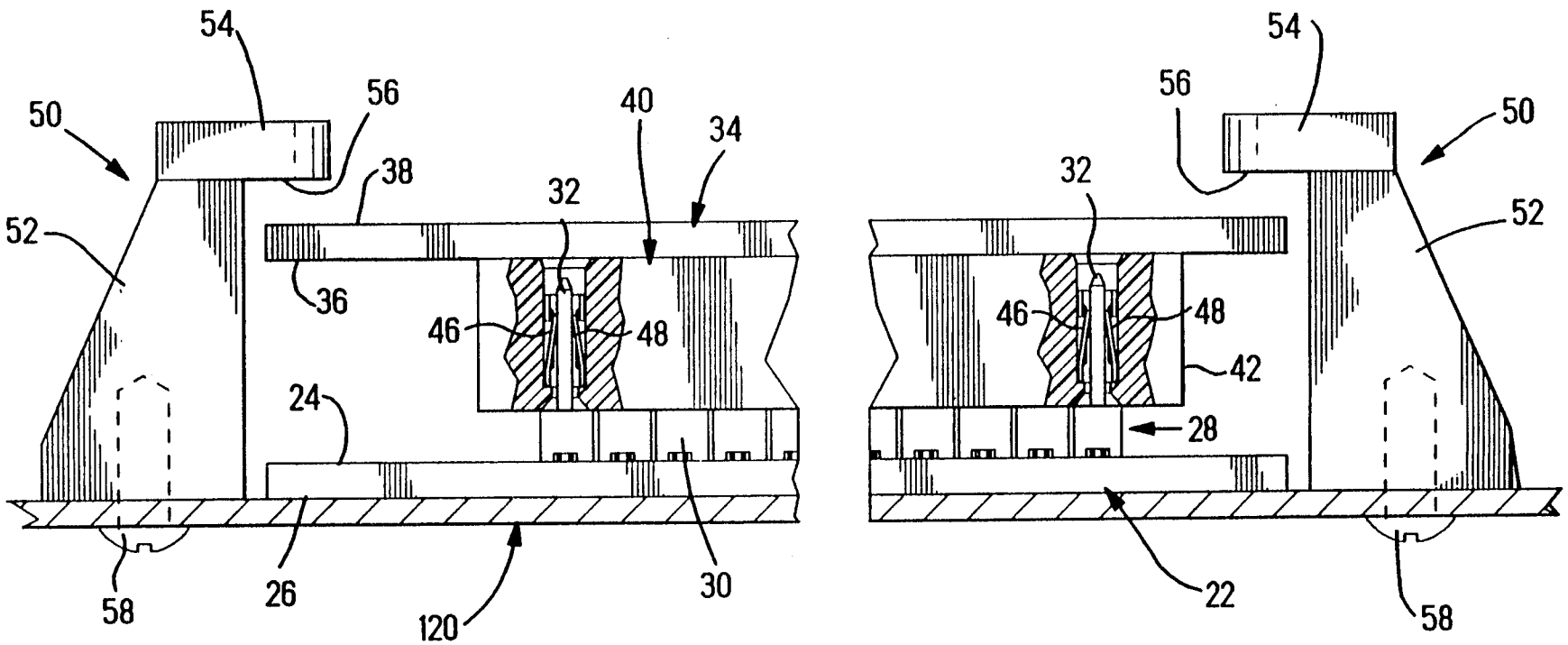
FIG. 3 is a side view of an electronic structure having the pin saving structure of the present invention.
Figure 5:
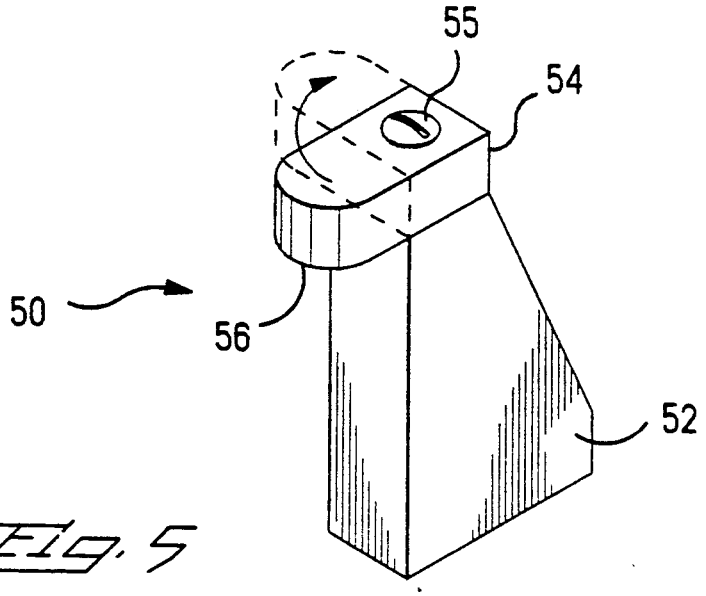
FIG. 5 is a perspective view of a preferred embodiment of the pin saving structure.

The stop means 50 of the present invention will be discussed with reference to FIGS. 3–8 in which the connectors 28, 40 are respectively mounted to parallel circuit boards 22, 34. FIG. 3 shows pin header connector 28 mounted to the upper surface 24 of circuit board 22, which in turn is mounted onto a chassis 120. Connector 40 mounted to circuit board 34 is fully mated to connector 28 as shown by the broken away portions. FIG. 3 also shows the stop means 50 of the present invention including a lower portion 52 and upper portion 54 having a lower stop surface 56. The upper portions 54 of the stop means 50 include transverse edges 56 that are preferably spaced a selected distance above the surface 38 of circuit board 34 to permit partial unmating of connectors 28, 40 while concomitantly preventing connector 40 on circuit board 34 from being completely removed from connector 28 without moving the upper stop portion to its second position. Stop means 50 is mounted directly to chassis 120 by mounting means 58 shown for purposes of illustration as a screw. It is to be understood that stop means 50 alternatively may be mounted to a circuit board, if space is available. Stop means 50 are positioned on a chassis or board at locations proximate the short end of the connectors if the boards are likely to be peeled apart along the longitudinal axis of the connectors and proximate the elongate sides of the connectors if the boards will be peeled apart at right angles to the elongate sides. As shown in FIG. 4, a pair of stop means 50 is designed to be used along opposing edges of a circuit board 34, which is parallel to the motherboard, to provide a stop means for removing the circuit board 34 from circuit board 22 (not shown in this figure) mounted to chassis 120. As shown in both FIGS. 4 and 5, the upper portion 54 of stop means 50 is rotatable from a first position which overlies a portion of the under surface 38 of circuit board 34 to a second position, shown in phantom, which is spaced away from the circuit board 34 thereby allowing complete removal of connector 40 and circuit board 34 from the back plane.

Figure 6:
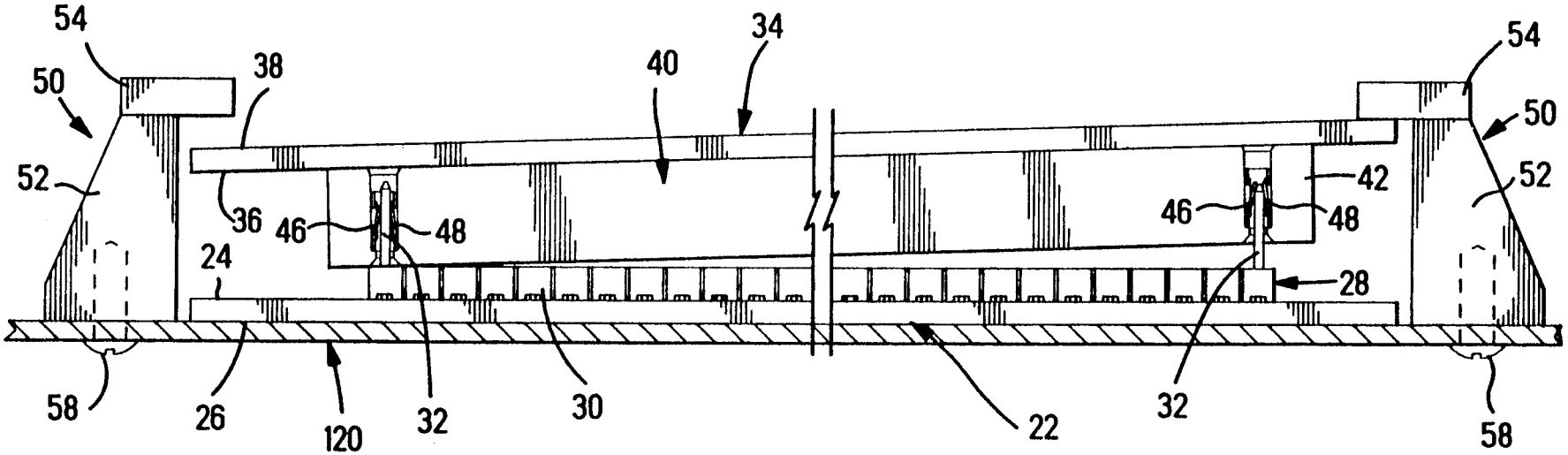
FIGS. 6–8 illustrate the steps in unmating connectors on parallel circuit boards in accordance with the invention.
Figure 7:
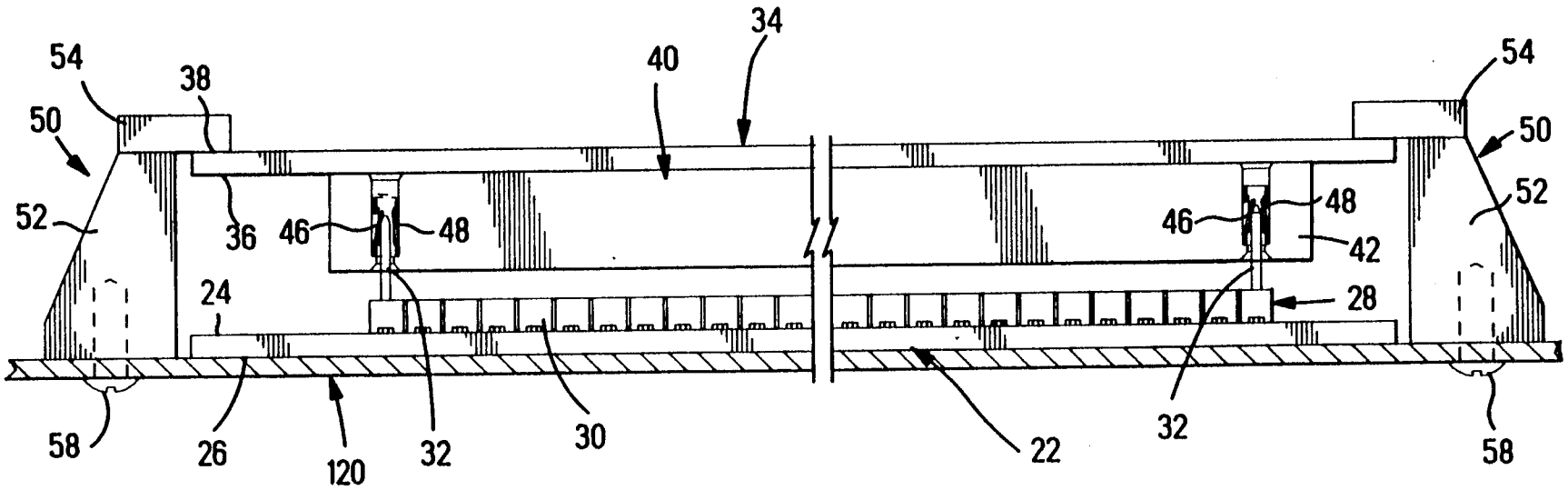
Figure 8:
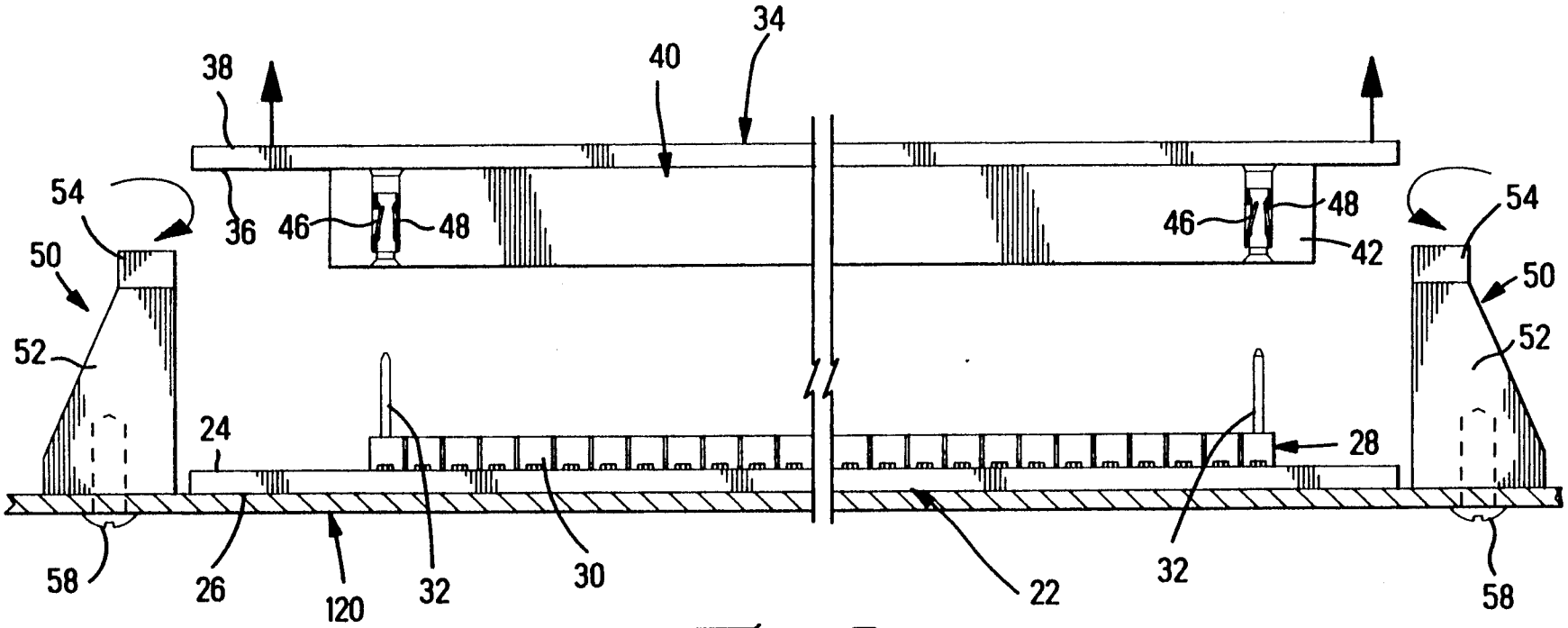

The process for unmating the connectors and separating the boards is best illustrated by referring to FIGS. 6, 7 and 8. As force is applied to lower surface 36 of board 34, the corresponding pin contacts 32 and receptacle contact portions 48 are partially unmated from each other as connector 40 is partially disconnected from connector 28. As shown in FIG. 6, board 34 can be raised only until the upper surface 38 engages the stop surface 56 of stop means 50. FIG. 6 further illustrates that even if connector 40 is subjected to a rotating motion during unmating, the pin contacts of pin header 28 still remain within the second housing 42 and the board 34 is not moved a sufficient distance to cause remaining contacts to be bent. As shown in FIG. 7, when both sides of the connector 40 are partially unmated from connector 28, the upper board surface 38 abuts respective stop surfaces 56 of the pair of means 50. Once the contact areas of the respective pins 32 and beams 48 of receptacles 46 have been disengaged from each other, the upper portion 54 of stop means 50 is then rotated from its first or closed position to its second or open position thereby allowing board 34 with connector 40 thereon to be completely disengaged from the mating connector 28. In accordance with the invention when the pair of stop means is in the first position the upper circuit board 34 is movable only a selected distance, sufficient to disengage the contact surfaces of the corresponding pins and receptacles 32,46 but not far enough to cause damage to any remaining pins and receptacle members. As can be shown by FIGS. 6 through 8, the pin contacts 32 can be removed from the corresponding receptacle contacts 46 in a direction such that the longitudinal axis of the contacts are maintained more nearly parallel to one another than was previously attainable without the use of the stop means. Accordingly, the pin contacts are able to be fully withdrawn from the receptacle contacts without pressing against the sidewalls of the receptacle contacts and without being bent thereby.

As shown in FIG. 3 the under surface 56 of stop means 50 is spaced from the upper surface 38 of circuit board 34. This distance between the upper board surface and the stop surface is selected to be one that allows the contact surfaces of the pin and receptacle members to be substantially disengaged from each other prior to removal of the top circuit board 34 and its associated connectors 40 from the assembly. This distance will change depending upon the dimensions of the connectors and the style of receptacle contacts used within those connectors.

Figure 9:
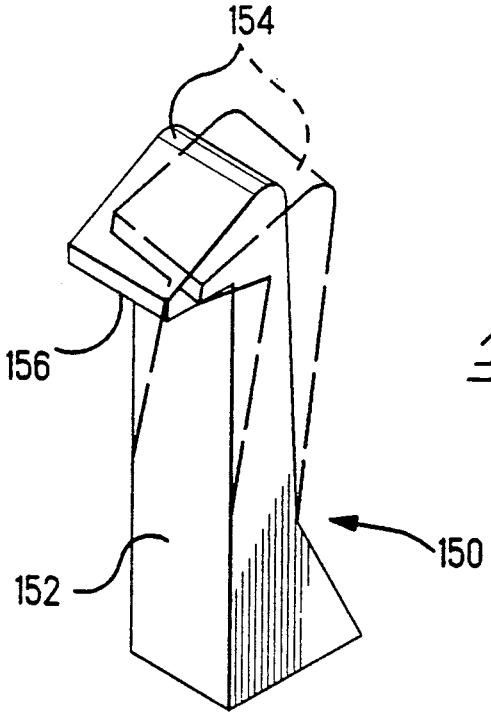
FIG. 9 shows an alternative embodiment of the pin saving member.

FIG. 9 illustrates an alternative embodiment 150 of the stop means having a lower portion 152 and an upper portion 154 with stop surface 156. In this embodiment stop means 150 is made from a material that is sufficiently resilient to allow the stop means 150 to be bent outwardly thereby moving upper portion 154 to move to the second or open position to allow complete removal of connector 40 and circuit board 34 from an assembly. The stop means may be made from suitable dielectric materials such as polyesters, and the like and may also be made from metal.

Figure 10:
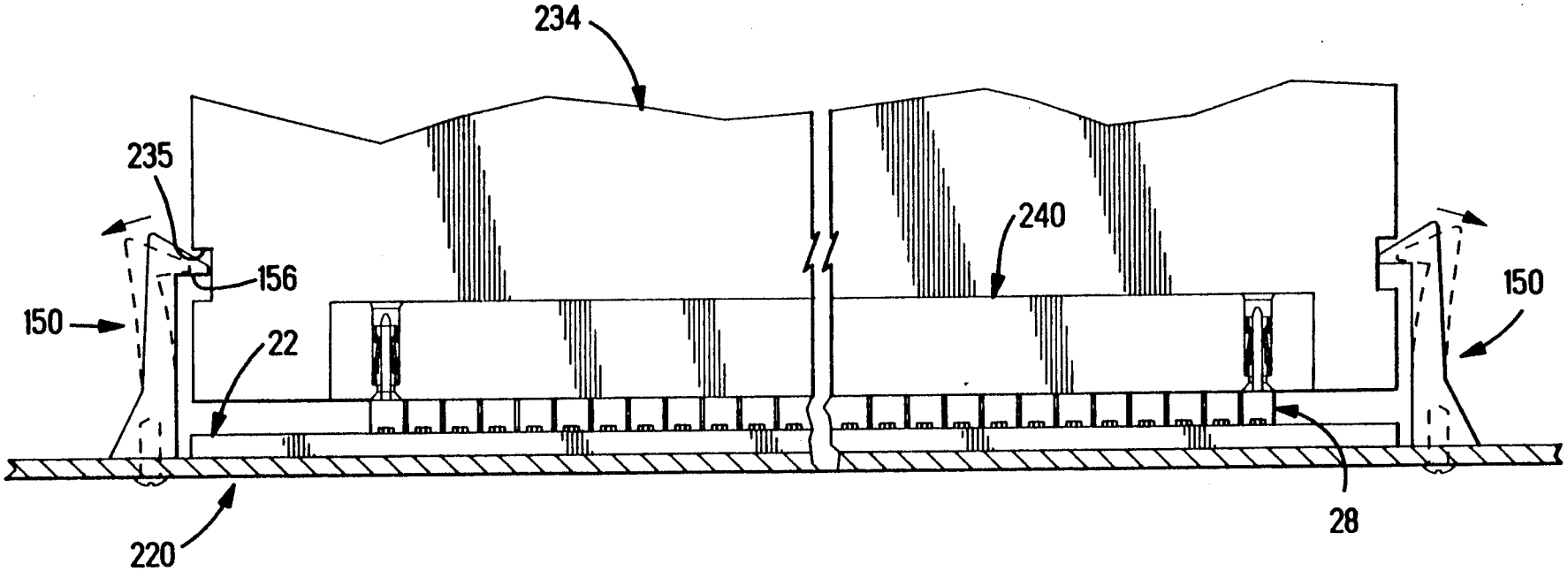
FIGS. 10 and 11 show further embodiments of the invention in which the pin saver member of FIG. 9 is used with connectors mounted to circuit boards having a perpendicular orientation to a mother board.
Figure 11:
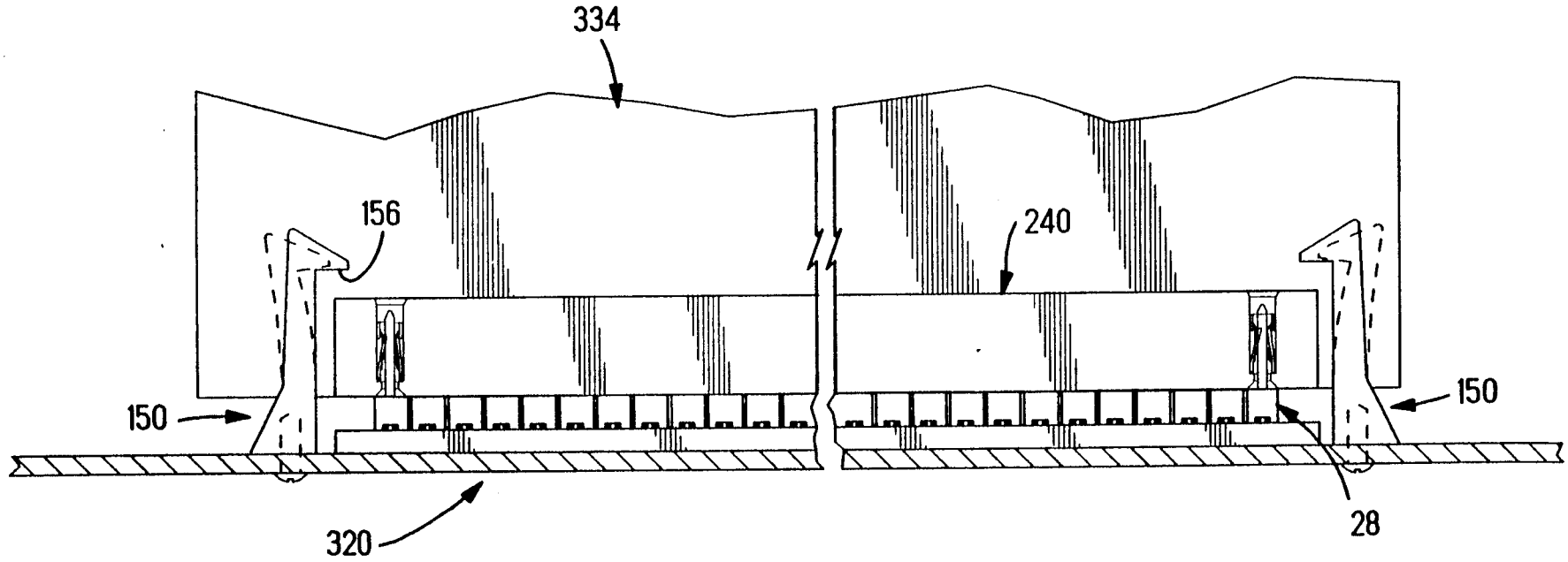

FIGS. 10 and 11 show the use of the stop means 150 of the present invention with a vertically mounted circuit board 234 wherein the connector 240 is mounted at right angles to the circuit board 234. In the embodiment shown in FIG. 10, circuit board 234 includes notches 235 along the outermost vertical edges of the circuit board 234, the notches 235 defining stop engaging surfaces, which engage the upper portion 154 of stop means 150 and again allow the board 234 to be removed a selected distance from board 22 prior to full disengagement of the respective connectors, 28,240. While the alternative embodiment 150 of the stop means is shown in FIGS. 10 and 11, it is to be understood that stop means 50 may also be used. In FIG. 11 the stop means 150 is positioned such that the upper portion 154 lies a selected distance above the housing of connector 240. As is further illustrated by FIGS. 10 and 11, when using the stop means of the present invention, with board mounted perpendicularly, it is desirable that a stop means be used for each daughter board that is mounted to the back plane of mother board. When the stop means is used between two parallel boards, as shown in FIG. 4, one pair of stop means 50 can be used to protect a plurality of elongate connectors mated between the two boards. It is to be understood that as the size of the parallel boards and number of mating connectors are increased, the number of pairs of stop means may be increased to provide protection for the plurality of connectors mated between the two circuit boards.

As can be appreciated from the foregoing description, the pin saver saving stop means occupies only a minimum amount of real estate on the circuit board thereby permitting the connectors and various components to be mounted to the boards in close proximity to each other.

It is thought that the stop means of the present invention and many of its attendant advantages will be understood from the foregoing description. Changes may be made in the form, construction and arrangement of parts thereof without departing from the spirit or scope of the invention or sacrificing all of its material advantages.

We claim:

1. An electronic assembly including:

a first subassembly including a first circuit board having at least one first elongate electrical connector mounted thereto, said first connector having at least one receptacle contact exposed along a mating face thereof;

a second subassembly including a second circuit board having at least one second elongate electrical connector mounted thereto, said second connector being adapted to mate with said first connector, said second connector having at least one pin contact extending forwardly of a forward face thereof and adapted to be received within a corresponding said at least one receptacle contact of said first connector when said first and second connectors are mated with each other;

at least one pair of stop means associated with one of the subassemblies and adapted to cooperate with stop engaging means of the other subassembly, said stop means including a lower portion extending in a direction perpendicular to the plane of the circuit board of the associated subassembly and an upper portion having a stop surface extending in a transverse direction from a leading end of said lower portion, said upper portion being adapted to be moved from a first position wherein said stop surface engages said stop engaging means to a second position wherein said stop surface is disengaged from said stop engaging means, said stop surface being spaced a selected distance from said associated subassembly to permit the first and second connectors to be partially unmated and the contact surfaces of the pin contacts to be withdrawn from the receptacle contacts while concomitantly preventing said first and second connectors from being fully separated, whereby if the connectors are unmated in a manner tending to rotate the respective circuit boards and connectors relatively to each other and the upper portions of said stop means are in their first positions, the transversely directed stop surfaces allow the contact surfaces of the pin contacts to be withdrawn from said receptacle contacts while preventing said connectors from rotating a sufficient amount to damage said pin contacts, said first and second connectors being completely separable upon moving said upper stop portions to their second positions.

2. The electronic assembly of claim 1 wherein said first and second connectors are parallel to each other when their respective connectors are mated.

3. The electronic assembly of claim 1 wherein said first and second connectors are perpendicular to each other when their respective connectors are mated.

4. The electronic assembly of claim 1 wherein said stop means includes lower and upper portions said upper portion being rotatably mounted to said lower portion.

5. The electronic assembly of claim 1 wherein said stop means is a unitary flexible member that can be resiliently moved from the first and second positions.

* * * * *